United States Patent [19]

Vutov et al.

[11] 4,393,916

[45] Jul. 19, 1983

[54] APPARATUS FOR PRESSURE DIE CASTING

[75] Inventors: Stancho H. Vutov; Rashko R. Slavov, both of Sofia, Bulgaria

[73] Assignee: Institute po Metaloznanie i Technologia na Metalite, Sofia, Bulgaria

[21] Appl. No.: 250,289

[22] Filed: Apr. 2, 1981

[30] Foreign Application Priority Data

Apr. 2, 1980 [BG] Bulgaria ..... 47207

[51] Int. Cl.[3] ..... B22D 17/06; B22D 18/00

[52] U.S. Cl. ..... 164/119; 164/121; 164/113; 164/284; 164/306

[58] Field of Search ..... 164/66.1, 113, 119, 164/120, 121, 259, 284, 306, 305, 312

[56] References Cited

U.S. PATENT DOCUMENTS

| | | | |
|---|---|---|---|
| 3,960,201 | 6/1976 | Portalier | 164/312 |
| 4,154,288 | 5/1979 | Borgen | 164/312 |
| 4,311,185 | 1/1982 | Zimmerman | 164/312 |
| 4,334,575 | 6/1982 | Miki et al. | 164/312 |

*Primary Examiner*—Nicholas P. Godici

*Assistant Examiner*—Jerold L. Johnson

[57] ABSTRACT

The invention relates to an apparatus for pressure die casting of metals and alloys involving the action of increased gas pressure on the solidifying melt. In this apparatus, the gas is pressurized automatically during the stroke of the press and pressurized gas at elevated pressure is applied to molten metal in the die cavity immediately after the closing of the die. For this purpose, the apparatus comprises a hydraulic press including a cylinder and a piston slidably mounted therein, which piston divides the cylinder into a first and second chamber. The first chamber is in communication with a source of pressurized liquid and the second chamber is in communication with a gas retaining cavity disposed in the piston rod of the piston. A press plate and die having at least one die cavity is rigidly mounted on the piston rod. The cavity of the die is connected by means of corresponding valves to a supply reservoir with gas under low pressure. The gas retaining cavity within the piston rod is filled up to a fixed level with working liquid from the hydraulic system of the press. The bottom part of this cavity is connected to the second chamber of the pressing cylinder below the piston. This second chamber is connected to the hydraulic system of the press by means of a valve. The upper part of the gas retaining cavity is connected simultaneously by means of a check valve to a supply reservoir for gas and by means of a shut-off valve to the die cavity. The die cavity is connected by means of another shut-off valve to the atmosphere.

3 Claims, 3 Drawing Figures

APPARATUS FOR PRESSURE DIE CASTING

BACKGROUND OF THE INVENTION

This invention relates to an apparatus for pressure die casting of metals and alloys involving the action of increased gas pressure on the solidifying melt.

In a known apparatus for pressure die casting of metals and alloys, the die is connected to the ram of the machine (i.e., the pressing piston) by means of a pneumatic piston, which is disposed within a pneumatic cylinder, while the compressing space in front of the pneumatic piston is connected to the cavities of the die, into which pressurized gas is delivered through gas conduits. At least one adjustable check valve is provided in the arrangement, which can be opened to vent the compression space in front of the pneumatic piston, acting towards the cavities of the die (see Bulgarian Pat. No. 21,077).

Drawbacks of this known apparatus are: the reduction of the usable stroke of the machine (i.e., the press) because of the inclusion of an additional unit, i.e., a pneumatic cylinder with piston, between the pressing piston and the die; the insecure guiding of the die during operation because of the movable connection between it and the pressing piston; and the requirement of first having to close the die and only then to begin the compression of the gas.

Another known apparatus for pressure die casting with increased gas pressure is a specialized hydraulic press with separate devices for closing the die and for pressing. It is provided with an independent hydropneumatic multiplier, disposed within the pressing piston and connected by means of corresponding valves to a supply reservoir for gas and to the die cavity. Only after closing of the die is there actuated the multiplier for increasing the pressure of the gas within the die cavity to the necessary level.

The drawbacks of this apparatus lie in its complicated design and in the impossibility to apply a high gas pressure immediately after the closing of the die.

SUMMARY OF THE INVENTION

It is therefore a general object of this invention to provide an apparatus for pressure die casting in which the pressurizing of the gas is effected automatically during the stroke of the press and the high gas pressure is applied on the processed material immediately after the closing of the die.

This object is achieved by an apparatus for pressure die casting comprising a hydraulic press with pressing cylinder and a piston dividing the cylinder into two spaces connected to the hydraulic system of the press, and a piston rod to which there are fastened the press plate and the die. At least one cavity is formed in the die, which is connected by means of corresponding valves to the supply reservoir with gas under low pressure. Within the piston rod there is formed a chamber, filled up to a fixed level with working liquid from the hydraulic system of the press. The bottom part of this chamber is connected to the space of the pressing cylinder below the piston. This space, in turn, is connected to the hydraulic system of the press by means of a valve. The upper part of the chamber is connected simultaneously by means of a check valve to a supply reservoir for gas and by means of a shut-off valve to the die cavity. The die cavity, in turn, is connected by means of another shut-off valve to the atmosphere.

The advantages of the apparatus of the invention lie in the avoiding of the necessity to develop systems for compression of the gas in each die and in providing the possibility to achieve a maximum level of the gas pressure immediately after the closing of the die.

BRIEF DESCRIPTION OF THE DRAWINGS

For a better understanding of the invention, reference should be made to the accompanying drawings in which there are illustrated preferred embodiments of the invention. In the drawings.

DETAILED DESCRIPTION

Figure 1:
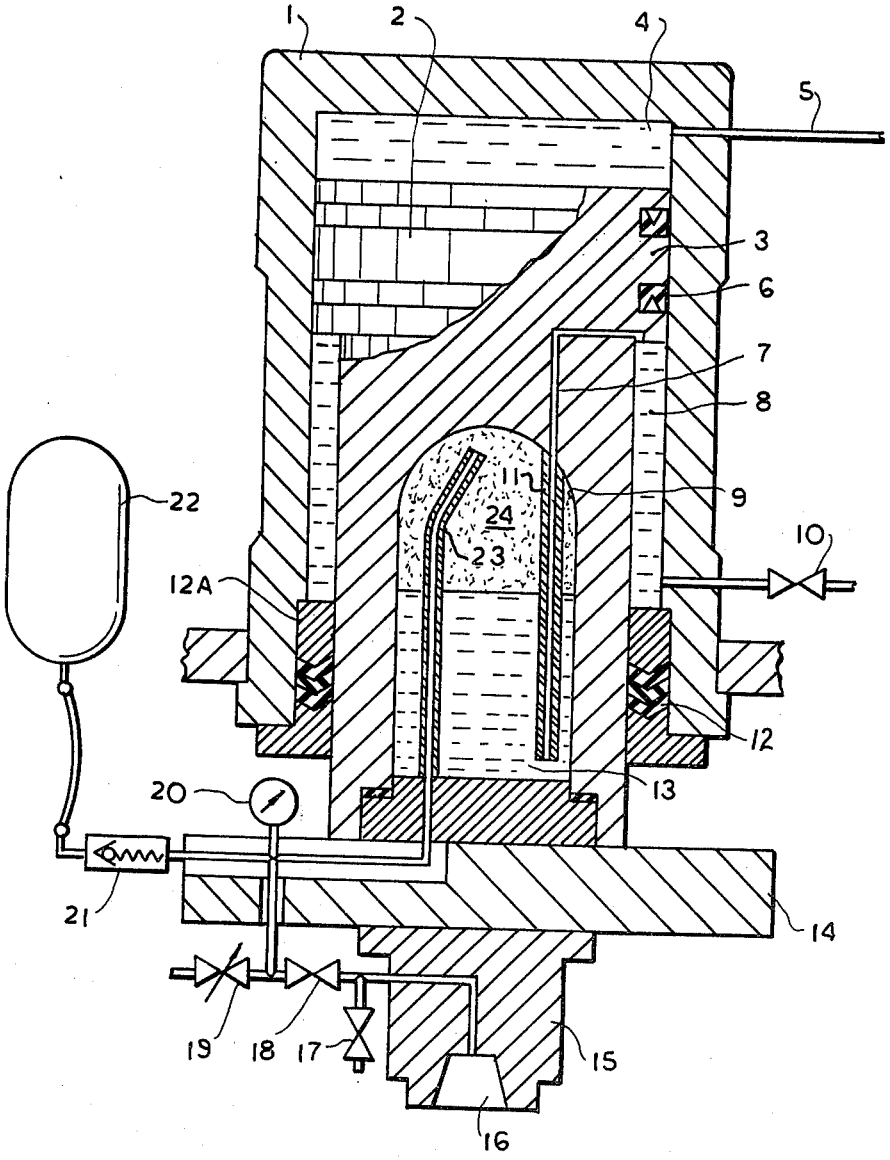
FIG. 1 is a schematic elevational illustration of the apparatus for pressure die casting wherein the pressing cylinder is illustrated in section.

The apparatus of the invention comprises a pressing cylinder 1, in which there is slidably mounted a pressing piston 2 and a piston rod 3. To the piston rod 3 there are fastened the press plate 14 and the die 15. The piston 2 is provided with sealing rings 6 to seal the space in front of piston 2 from the space behind it in the cylinder 1. The piston rod 3 is slidable in a sleeve 12A mounted in the open bottom of cylinder 1, which slidable movement is sealed by means of sealing component 12. The space 4 above the piston 2 is connected to the hydraulic system of the press by means of a pipe conduit 5. The space 8 of the pressing cylinder below the piston 2 is connected to the hydraulic system of the press by means of a valve 10. Inside the piston rod 3 there is formed a chamber 9, which is filled to a fixed level with working liquid 13 from the hydraulic system of the press. The remaining part of chamber 9 is filled with gas 24. The bottom part of chamber 9 is connected by means of a pipe 11 and a channel 7 to the space 8 below the piston 2. The upper part of chamber 9 is connected by means of a pipe 23 simultaneously through a check valve 21 to a supply reservoir 22 for gas, and through a shut-off valve 18 to the cavity 16 of the die 15, and through an adjustable safety valve 19 to the atmosphere. The cavity 16 of the die 15 is connected to the atmosphere through a shut-off valve 17. The chamber 9 is also connected to a pressure gauge 20 for checking the pressure level.

MANNER OF OPERATION

The apparatus operates as follows:

In the initial position, valve 10 and valves 17 and 18 are closed. After a predetermined pressure is produced in space 4 of cylinder 1 by piping in pressurized liquid via conduits, the pressing piston 2 moves downwards. This causes the working hydraulic liquid in the space 8 disposed below the piston 2 to be pushed through channel 7 and pipe 11 into the chamber 9, which causes a reduction of volume or an increase of the pressure of the gas 24 therein, respectively. This process continues until the pressure in the chamber 9 and in the chamber 8 below the piston 2 reaches the level fixed by adjusting the adjustable safety valve 19. With a further downward movement of the piston 2, the pressure is not further increased since part of the gas 24 is released through the safety valve 19 into the atmosphere. After the closing of the die 15, pressurized gas is delivered through valve 18 into the cavity 16. After the solidification of the cast body in the die 15, valve 18 is closed, valve 17 is opened for the release into the atmosphere of the gas remaining within the die 15, and a command for back-stroking of the pressing piston is given, i.e., the pressure in space 4 is released by connecting the pipe conduit 5 to the reservoir of the press. Initially, the piston 2 moves together with the die 15 upwards under pressure of the action of the gas within the chamber 9, while the working liquid 13 return flows into the space 8 below the piston 2. After the equalizing of the pressure in chamber 9 and in the supply reservoir 22, the further movement of piston 2 upwards is effected at the expense of the passing of an additional quantity of gas under low pressure from the supply reservoir 22 through the check valve 21 in chamber 9; as a result of this, the apparatus returns to its initial position.

If the valve 10 is opened and the connection between the chamber 9 and the supply reservoir 22 is interrupted, the apparatus operates as a normal hydraulic press.

Figure 2:
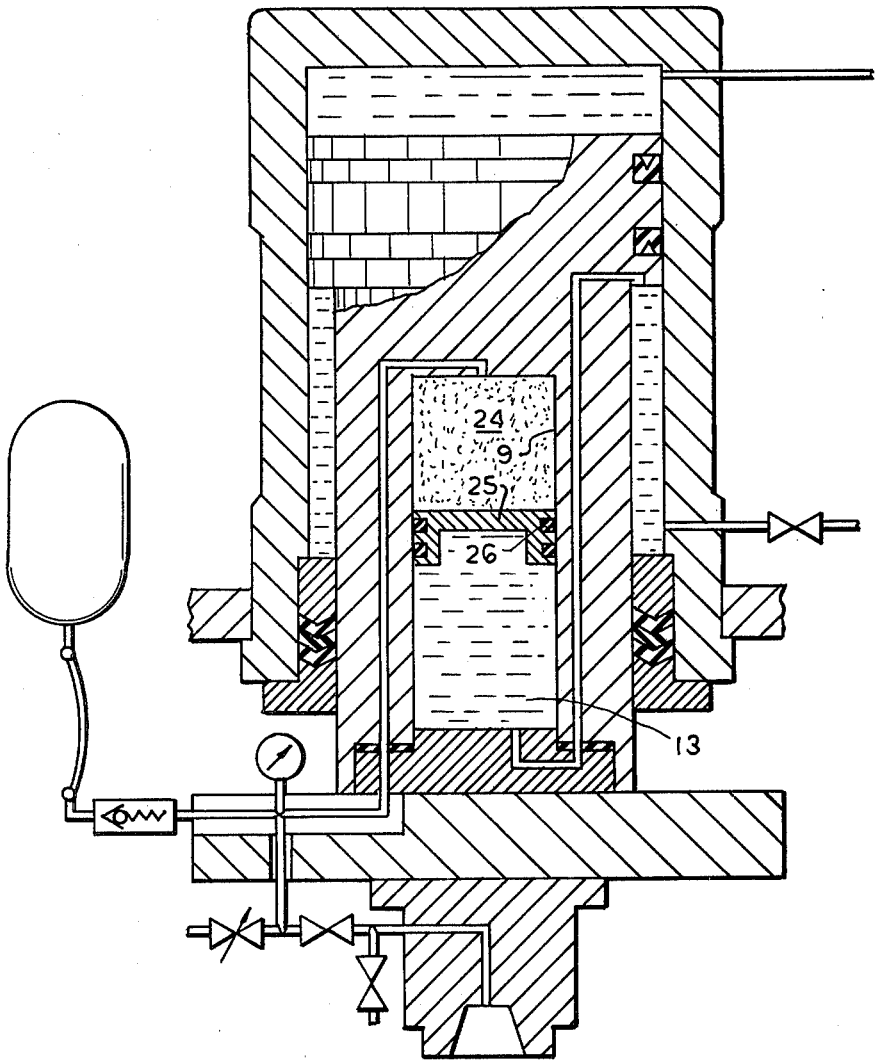
FIG. 2 and FIG. 3 are schematic elevational illustrations similar to FIG. 1 of two other embodiments of the invention.
Figure 3:
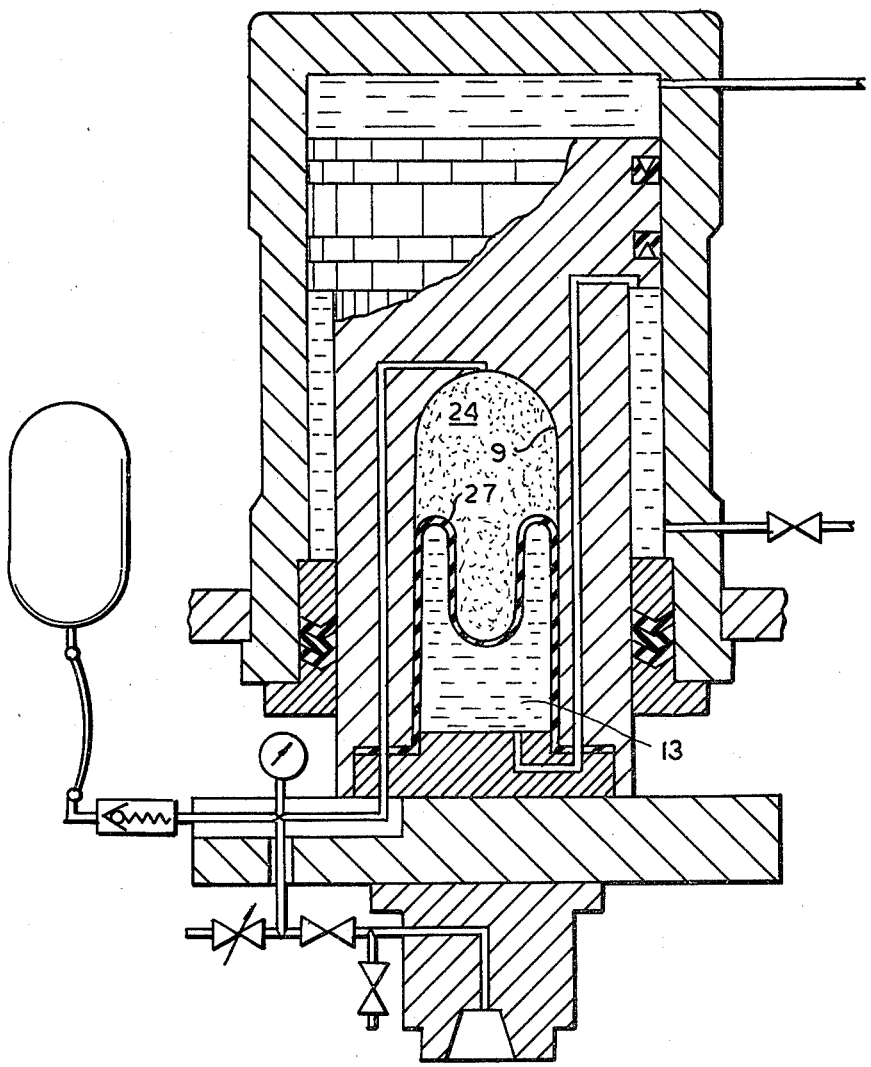

In the embodiments of FIGS. 2 and 3, the parts of the apparatus which correspond to the embodiment of FIG. 1 have not been supplied with reference numbers. In the second embodiment of the apparatus of the invention as illustrated in FIG. 2, a movable partition 25 is provided in chamber 9 between the working liquid 13 and the gas 24. This partition 25 is formed as a floating piston, which is sealed towards the wall of chamber 9 by means of ring-shaped sealing components 26. Thus, there is avoided a direct contact of the gas with the working liquid, as well as the danger of eventual undesired interaction between them.

In the third embodiment of the invention as illustrated in FIG. 3, the movable partition is formed as an elastic membrane 27, which is fastened rigidly within chamber 9.

Although the invention is illustrated and described with reference to a plurality of preferred embodiments thereof, it is to be expressly understood that it is in no way limited to the disclosure of such preferred embodiments but is capable of numerous modifications within the scope of the appended claims.

We claim:

1. An apparatus for pressure die casting by using elevated gas pressure in a die, comprising in combination, a hydraulic press including a cylinder and a piston having an axially extending piston rod, said piston being slidably mounted in said cylinder; said piston dividing said cylinder into a first chamber and a second chamber, which chambers are filled with hydraulic liquid from a source of pressurized liquid for said hydraulic press;

die means including a die cavity are rigidly connected to said piston rod;

said piston rod including a gas retaining cavity which is in communication via first valve means with a reservoir of pressurized gas;

said gas retaining cavity containing a predetermined quantity of hydraulic liquid in its bottom portion which is in communication via a passage in said piston rod with said second chamber in said cylinder;

said second chamber being in communication with said source of pressurized liquid via second valve means;

an upper portion of said gas retaining cavity being also in communication with said die cavity via a third valve means;

and fourth valve means operatively connected to said die cavity for venting it to the atmosphere;

whereby when said third and fourth valve means are closed and the hydraulic liquid in the first chamber is pressurized via said source of pressurized liquid, the piston is caused to slidably move downwardly in said cylinder causing hydraulic liquid to flow from said second chamber into said gas retaining cavity via said passage in said piston which causes the gas contained therein to be additionally pressurized to a predetermined equilibrium and thereafter said pressurized gas being caused to flow into the die cavity via said third valve means.

2. The apparatus for pressure die casting by using elevated gas pressure in the die as set forth in claim 1, including a rigid partition wall slidably disposed in said gas retaining cavity which wall separates the pressurized gas and pressurized liquid contained therein.

3. The apparatus for pressure die casting by using elevated gas pressure in the die as set forth in claim 1, including a flexible partition wall mounted in said gas retaining cavity and separating said pressurized gas and pressurized liquid contained therein.

* * * * *